US007008100B2

(12) United States Patent
Sergio

(10) Patent No.: US 7,008,100 B2
(45) Date of Patent: Mar. 7, 2006

(54) VIBRATING MACHINE WITH CAM DRIVEN SAMPLE HOLDERS

(76) Inventor: Szabo Miszenti Sergio, Via Pellizza da Volpedo, 109, 20092, Cinisello Balsamo (MI) (IT)

( * ) Notice: Subject to any disclaimer, the term of this patent is extended or adjusted under 35 U.S.C. 154(b) by 169 days.

(21) Appl. No.: 10/613,829

(22) Filed: Jul. 3, 2003

(65) Prior Publication Data

US 2004/0008568 A1 Jan. 15, 2004

(30) Foreign Application Priority Data

Jul. 4, 2002 (IT) ..... MI2002A1476

(51) Int. Cl.
*B01F 11/00* (2006.01)

(52) U.S. Cl. ..... 366/110; 366/212

(58) Field of Classification Search ..... 366/208–209, 366/110, 212, 219, 605; 74/55, 569
See application file for complete search history.

(56) References Cited

U.S. PATENT DOCUMENTS 1,328,379 A * 1/1920 Johnson
3,643,671 A * 2/1972 Henninges et al.
4,316,672 A * 2/1982 Kerscher
4,747,693 A * 5/1988 Kahl
5,145,339 A * 9/1992 Lehrke et al.
5,273,357 A * 12/1993 Currie
5,467,706 A * 11/1995 Kato
5,687,645 A * 11/1997 Kato
2004/0008568 A1 * 1/2004 Sergio

FOREIGN PATENT DOCUMENTS

DE 3213707 C1 * 2/1984
EP 1378287 A1 * 1/2005
EP 1201297 A1 * 10/2005

* cited by examiner

*Primary Examiner*—Charles E. Cooley
(74) *Attorney, Agent, or Firm*—Hedman & Costigan, P.C.

(57) ABSTRACT

A vibrating machine, specifically designed for extracting, mixing and separating liquid and powder organic and inorganic materials, in liquid or powder form, comprises two shoulders supporting a plurality of test tubes, each shoulder being rigidly coupled to a cam follower, affected by a cam in turn driven by a motor, so as to cause the test tube supporting shoulders to perform a rectilinear reciprocating symmetrically opposite movement.

5 Claims, 6 Drawing Sheets

3
17
19
10
15
13
16
14
20
18
2

VIBRATING MACHINE WITH CAM DRIVEN SAMPLE HOLDERS

BACKGROUND OF THE INVENTION

The present invention relates to a vibrating machine, which has been specifically designed for extracting, mixing and separating organic and inorganic materials, both in a liquid and powder form.

More specifically, the present invention provides a machine which is particularly suitable for preparing samples for analyzing DNA.

As is known, in the chemical and biochemical search field, a lot of laboratory procedures require that the test tubes holding the material to be analyzed be subjected to strong vibrating or stirring movements.

To this end, are already available stirring machines designed for vibrating or stirring the test tubes engaged in engaging trays or vessels.

A problem affecting available stirring or vibrating machines, is that the generated vibrations are also transmitted to the work table or bench thereof.

Another problem of prior vibrating machines is that of the strong and objectable noise generated by the vibrations.

SUMMARY OF THE INVENTION

Accordingly, the aim of the present invention is to provide such a vibrating machine, specifically designed for extracting, mixing and separating organic and inorganic materials, both in liquid and powder form, which overcomes the above mentioned problems.

Within the scope of the above mentioned aim, a main object of the invention is to provide such a vibrating machine which is very strong and stable construction-wise and is very reliable in operation.

Another object of the present invention is to provide such a vibrating machine of high operating yield, and which, moreover, has a very simple and inexpensive construction.

According to one aspect of the present invention, the above mentioned aim and objects, as well as yet other objects, which will become more apparent hereinafter, are achieved by a vibrating machine, for extracting, mixing and separating organic and inorganic materials, both in liquid and powder form, characterized in that said vibrating machine comprises two supporting shoulders adapted to support a plurality of test tubes, each said supporting shoulder being rigidly coupled to a cam follower affected by a cam in turn driven by a motor, to cause said test tube supporting shoulders to perform a rectilinear symmetrically opposite reciprocating movement.

BRIEF DESCRIPTION OF THE DRAWINGS

Further characteristics and advantages of the present invention will become more apparent hereinafter from the following detailed disclosure of the preferred, though not exclusive, embodiment of the invention, which is illustrated, by way of an indicative, but not limitative example, in the accompanying drawings, where.

DESCRIPTION OF THE PREFERRED EMBODIMENT

Figure 1:
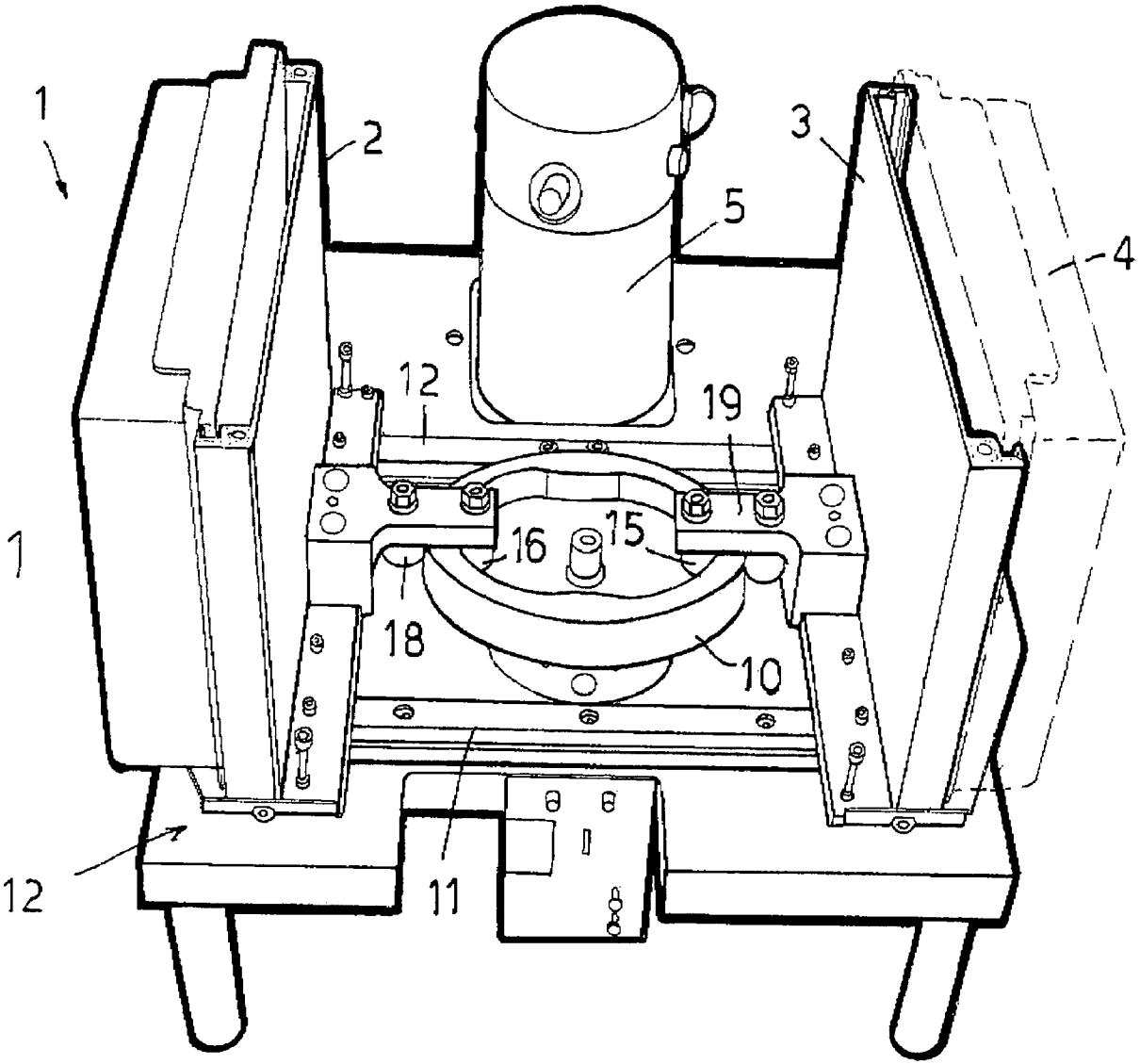
FIG. 1 is a perspective view of the vibrating machine according to the invention.
Figure 2:
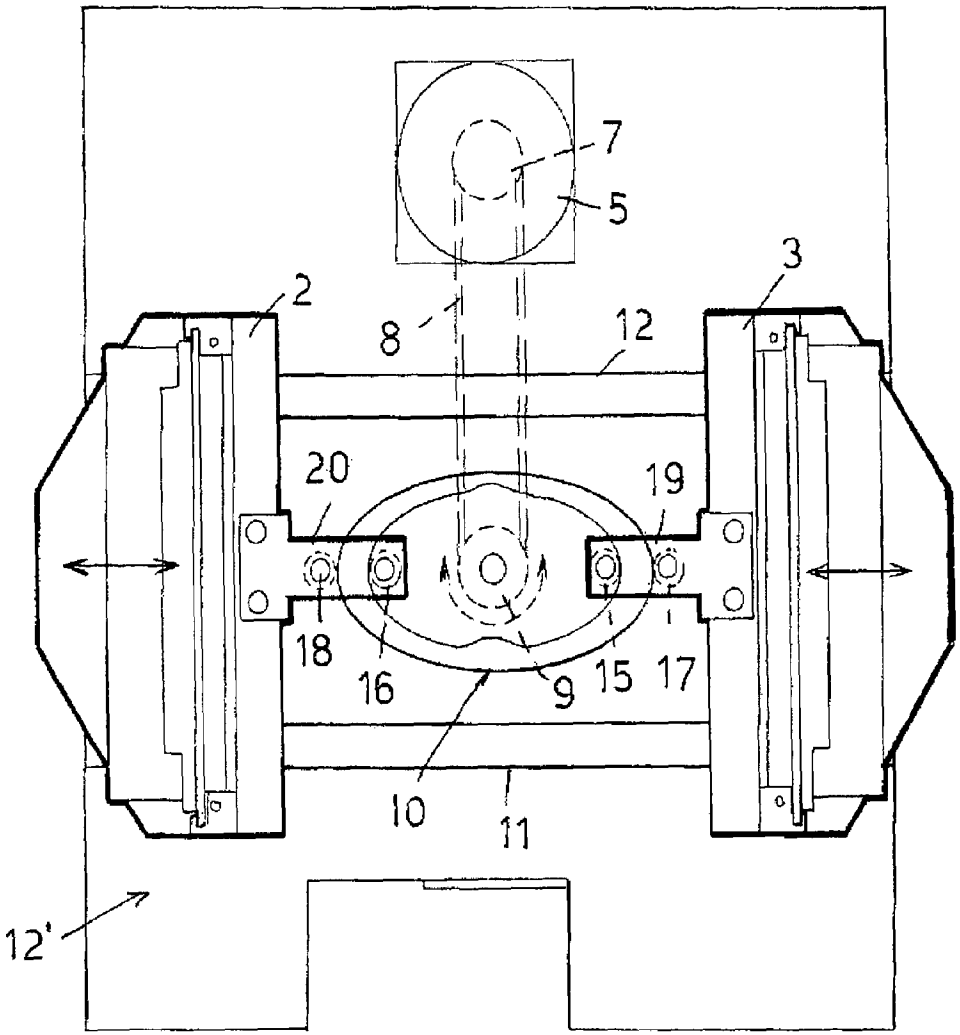
FIG. 2 is a top plan view of the vibrating machine according to the invention, showing the supporting shoulders thereof at an outward displaced end position.
Figure 3:
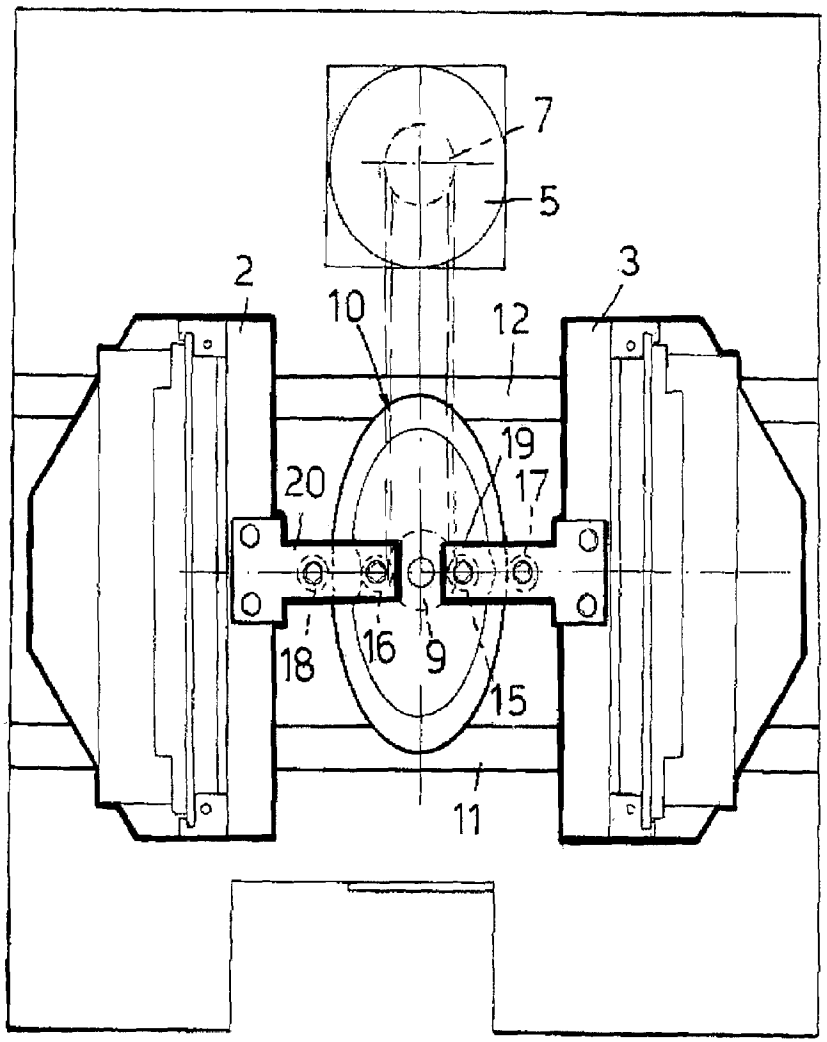
FIG. 3 is a view similar to FIG. 2, illustrating the supporting shoulders at an inward displaced end position.
Figure 4:
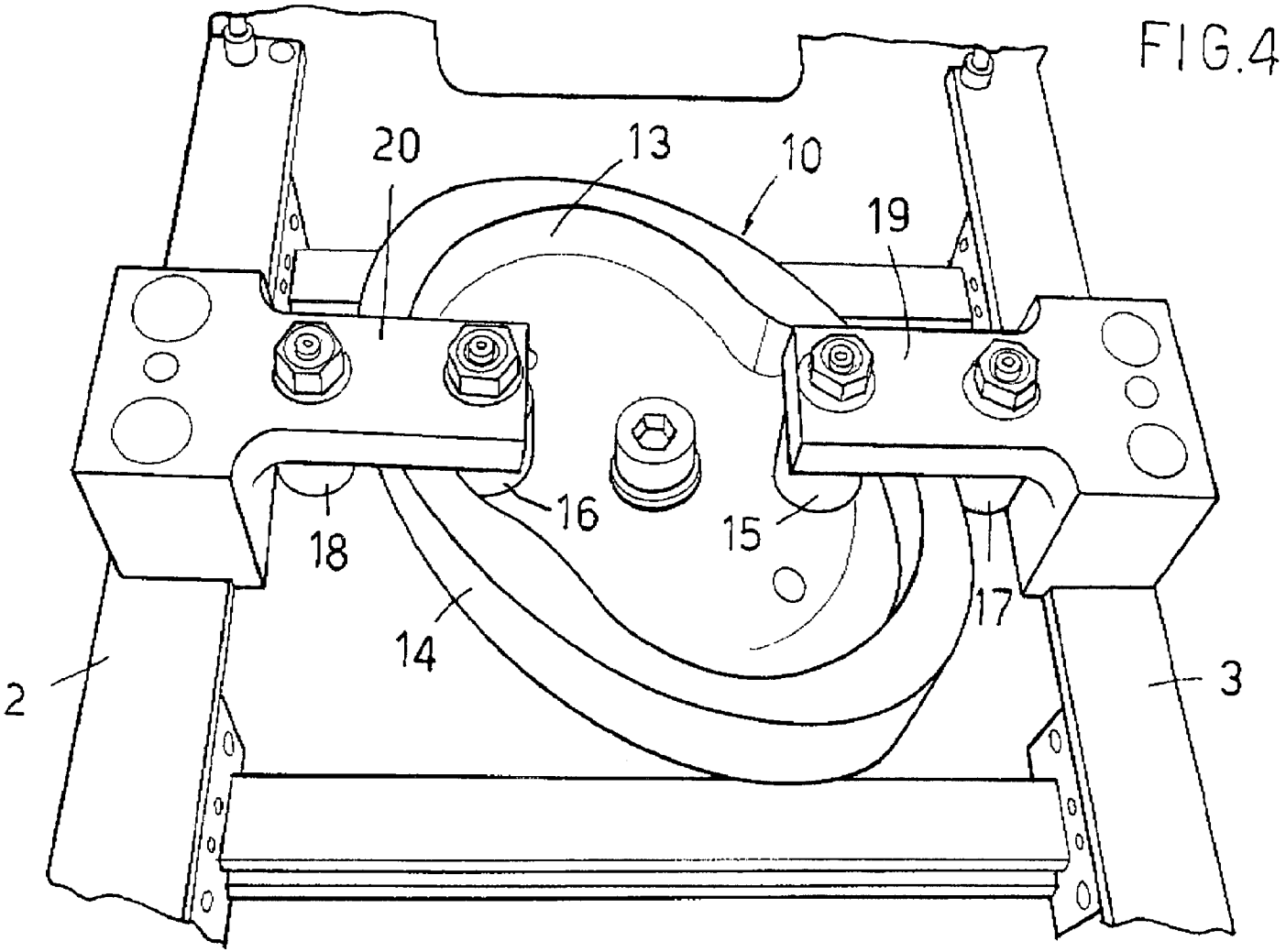
FIG. 4 is an enlarged perspective view of the desmodromic cam.
Figure 5:
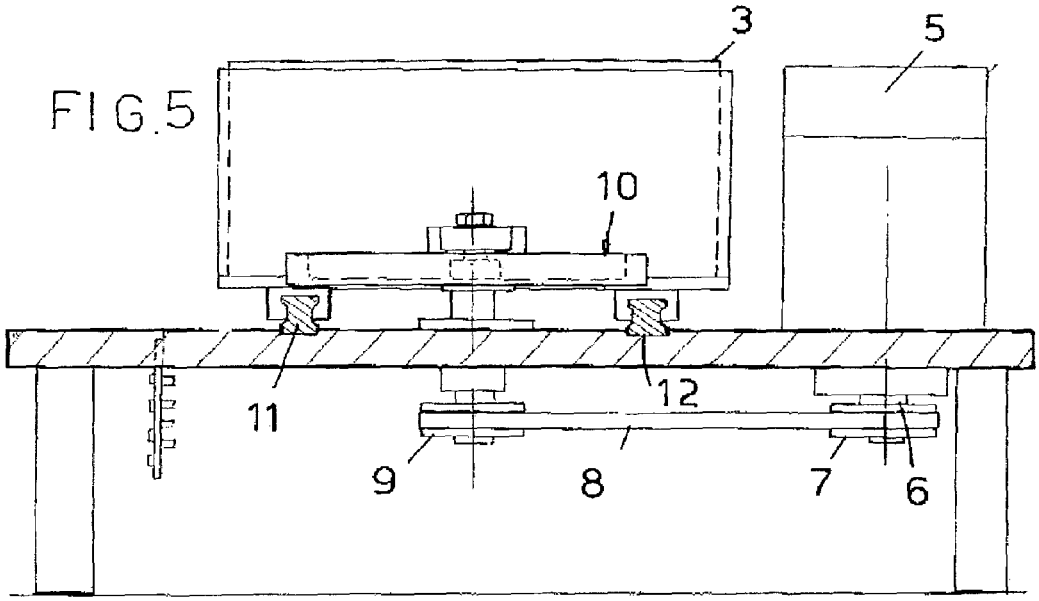
FIG. 5 is a partially cross-sectioned side elevation view of the vibrating machine.

With reference to the number references of the above mentioned figures, the vibrating machine, according to the present invention, which has been generally indicated by the reference number 1, comprises two supporting shoulders 2 and 3, provided for supporting a plurality of test tubes, for example included in specifically designed test tube vessels 4.

More specifically, said supporting shoulders 2 and 3 are coupled to a pair of parallel guides 11, 12 rigid with the framework 12' of the vibrating machine, and adapted to allow a bidirectional rectilinear movement, as it will be disclosed in a more detailed manner hereinafter.

The vibrating machine according to the invention further comprises a variable speed electric motor 5, which is electrically controlled, and comprises an electric motor shaft 6.

On the electric motor shaft 6 is supported a pulley 7, thereon is engaged a driving belt 8, rotatively driving a second pulley 9 keyed on a further shaft supporting a cam 10.

The operation of the cam 10 is preferably of a desmodromic type.

In fact, said cam 1 has an inner contour 13 and an outer contour 14, different from the inner contour, thereon respectively side inner follower rollers 15 and 16 and outer follower rollers 17 and 18.

An inner follower roller 16 is pivoted, together with a respective outer follower roller 17, to an arm 19, rigid with the supporting shoulder 3.

The other inner follower roller 16 is pivoted, together with its respective outer follower roller 18, to an arm 20 rigid with the supporting shoulder 2.

Thus, as the cam 10 is rotatively driven, the two opposite supporting shoulders will perform a rectilinear reciprocating movement, along the sliding guides 11 and 12.

Thus, the test tubes supporting shoulders 2 and 3 will perform a symmetrically opposite movement, thereby allowing said supporting shoulders to be perfectly dynamically balanced.

Figure 6:
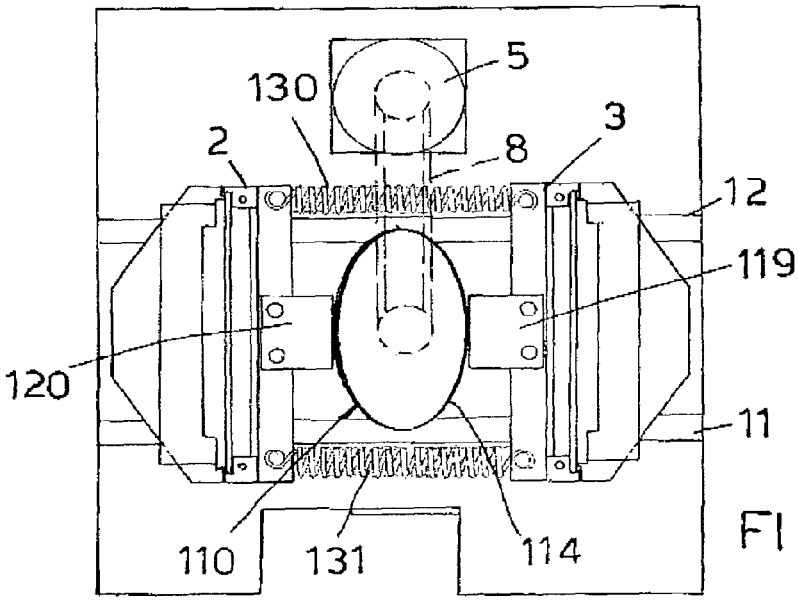
FIG. 6 is a further top plan view of the vibrating machine including a non desmodromic cam.
Figure 8:
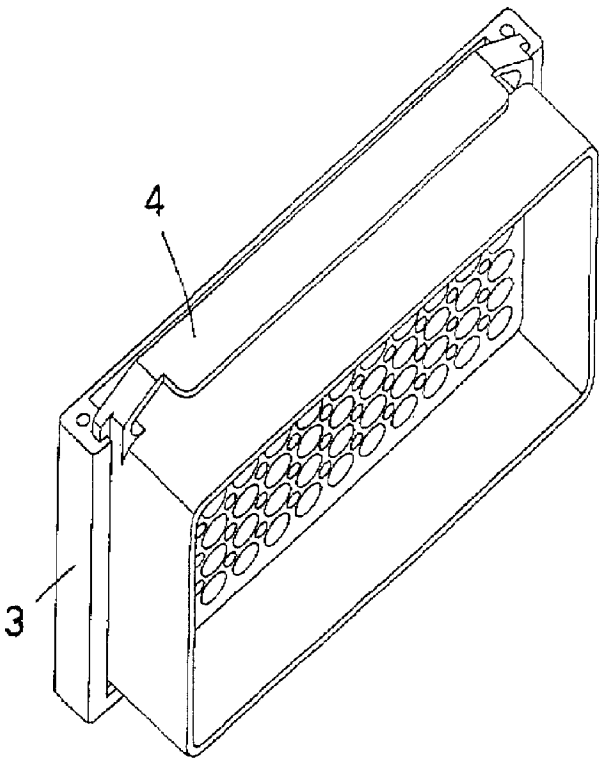
FIG. 8 is a view similar to FIG. 7, illustrating a possible application of the test tube vessel to the machine shoulder.
Figure 7:
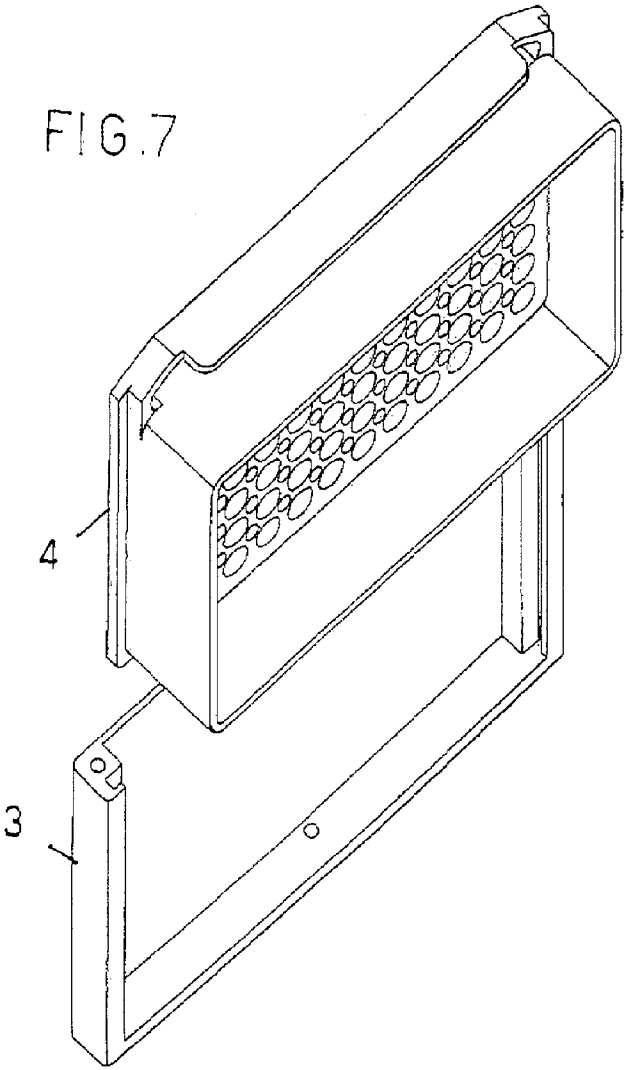
FIG. 7 is an exploded perspective view of a shoulder and a test tube holder vessel of the vibrating machine.

FIG. 6 show a possible embodiment of the non-desmodromic cam.

This non-desmodromic cam, generally indicated by the reference number 110, comprises a single outer contour 114, on which slide two cam followers, associated with respective arms 119 and 120, coupled to the supporting shoulders 2 and 3.

Said supporting shoulders 2 and 3 are connected by a pair of return springs 130 and 131, allowing the cam followers to follow the contour 114 of the cam 110.

It has been found that the invention fully achieves the above mentioned aim and objects.

In fact, the invention provides a machine which does not generate objectable vibrations, since it is perfectly balanced.

Thus, said machine does not transmit vibrations to the supporting table on which the machine is mounted.

In practicing the invention, the used materials, as well as the contingent size and shapes, can be any, according to requirements and the status of the art.

What is claimed is:

1. A vibrating machine, for extracting, mixing and separating organic and inorganic materials, both in liquid and powder form, in particular for preparing samples for analyzing DNA, wherein said vibrating machine comprises a framework slidably supporting two opposite supporting shoulders each holding therein a respective test tube vessel containing a plurality of test tubes, said supporting shoulders being coupled to a pair of parallel guides rigid with said framework of said vibrating machine, each said supporting shoulder being rigidly coupled to cam follower means affected by a cam in turn driven by a variable speed electronically controlled electric motor, to cause said test tube supporting shoulders to perform a rectilinear symmetrically opposite reciprocating movement, and wherein said cam follower means are rigidly coupled by rigid arm means to said shoulders.

2. A vibrating machine, according to claim 1, wherein said motor comprises a motor shaft on which is mounted a pulley, thereon is entrained a transmission belt rotatively driving a second pulley keyed on a second shaft supporting said cam.

3. A vibrating machine, according to claim 1, characterized in that said cam is a desmodromic cam, having an inner contour and a different outer contour, thereon respectively slide inner follower rollers and outer follower rollers of said cam follower means.

4. A vibrating machine, according to claim 3, wherein a said inner follower roller is pivoted, together with a respective said outer follower roller, to an arm rigid with a said supporting shoulder, whereas the other said inner follower roller is pivoted, together with a respective outer follower roller, to a second arm rigid with the other said supporting shoulder.

5. A vibrating machine, according to claim 1, wherein said cam is a non-desmodromic cam, comprising a single outer contour, thereon slide two cam followers associated with respective arms rigidly connected to said supporting shoulders, said supporting shoulders being in turn connected by a pair of return springs, allowing said cam follower means to follow the cam contour.

* * * * *